US009499336B2

(12) United States Patent
Kapelski

(10) Patent No.: US 9,499,336 B2
(45) Date of Patent: Nov. 22, 2016

(54) FULLY AUTONOMOUS LASHING PLATFORM

(75) Inventor: Rainer Kapelski, Boel (DE)

(73) Assignee: KALP GmbH, Boel (DE)

( * ) Notice: Subject to any disclaimer, the term of this patent is extended or adjusted under 35 U.S.C. 154(b) by 596 days.

(21) Appl. No.: 13/635,282

(22) PCT Filed: Jan. 14, 2011

(86) PCT No.: PCT/DE2011/000029

§ 371 (c)(1),
(2), (4) Date: Sep. 14, 2012

(87) PCT Pub. No.: WO2011/147389

PCT Pub. Date: Dec. 1, 2011

(65) Prior Publication Data

US 2013/0056093 A1 Mar. 7, 2013

(30) Foreign Application Priority Data

May 28, 2010 (DE) ..... 10 2010 021 822

(51) Int. Cl.
*B65D 90/12* (2006.01)
*B65D 90/00* (2006.01)

(52) U.S. Cl.
CPC ..... *B65D 90/002* (2013.01); *B65D 90/125* (2013.01); *Y10T 137/6851* (2015.04)

(58) Field of Classification Search
CPC ... B65D 90/002; B65D 90/125; F15B 1/024; B66F 9/186
USPC ..... 60/414
See application file for complete search history.

(56) References Cited

U.S. PATENT DOCUMENTS

| | | | | |
|---|---|---|---|---|
| 4,723,107 | A * | 2/1988 | Schmid | F15B 21/14 318/139 |
| 4,779,691 | A * | 10/1988 | Werdner | 180/8.3 |
| 4,983,094 | A * | 1/1991 | Ping | B66F 9/186 294/81.1 |
| 8,061,951 | B2 * | 11/2011 | Marston | B66C 1/101 294/68.26 |
| 2009/0120084 | A1 * | 5/2009 | Baltes | 60/414 |
| 2009/0199517 | A1 * | 8/2009 | Kapelski | 53/476 |
| 2009/0282822 | A1 * | 11/2009 | McBride et al. | 60/415 |

FOREIGN PATENT DOCUMENTS

| | | |
|---|---|---|
| DE | 10023436 | 11/2001 |
| DE | 202006003435 | 4/2006 |
| DE | 102009020999 | 11/2010 |
| JP | 2002145572 A * | 5/2002 |
| WO | WO 2007/021246 | 2/2007 |
| WO | WO 2007/098749 | 9/2007 |

* cited by examiner

*Primary Examiner* — Thomas E Lazo
*Assistant Examiner* — Abiy Teka
(74) *Attorney, Agent, or Firm* — Diederiks & Whitelaw, PLC

(57) ABSTRACT

Lashing platform with a mount for mounting a container set down on the lashing platform, wherein the mount is spring-mounted in the vertical direction and is connected via a first line to a gas storage unit for storing the energy released when setting the container down on the mount of the lashing platform, and the gas storage unit is connected via a second line to screwing devices which are supplied with energy from the gas storage unit and are intended for removing twist-locks from and inserting them into the container, characterized by a third line connected to the first line and/or to the gas storage unit, and a generator for producing electrical energy that is driven by the volumetric flow conveyed in the third line.

15 Claims, 1 Drawing Sheet

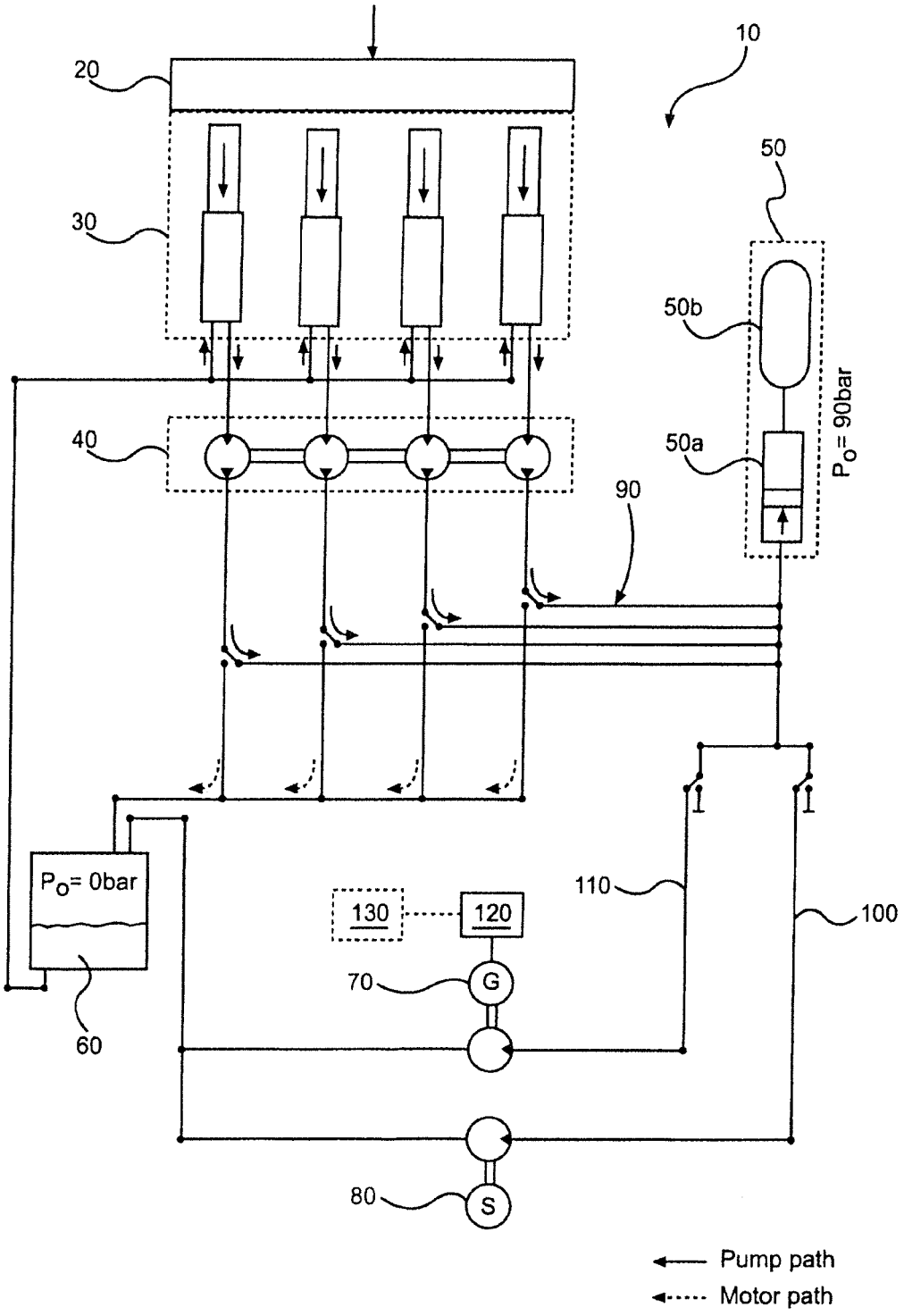
10
20
30
40
50
50a
50b
$P_O$= 90bar
90
$P_O$= 0bar
60
130
120
70
G
110
100
80
S
Pump path
Motor path

FULLY AUTONOMOUS LASHING PLATFORM

CROSS-REFERENCE TO RELATED APPLICATIONS

This application represents a National Stage application of PCT/DE2011/000029 entitled "Fully Autonomous Lashing Platform" filed Jan. 14, 2011, pending.

BACKGROUND OF THE INVENTION

The invention relates to a lashing platform with a mount for mounting a container set down on the lashing platform, wherein the mount is spring-mounted in the vertical direction and is connected via a first line to a gas storage means for storing the energy released when setting the container down on the mount of the lashing platform, and the gas storage means is connected via a second line to screwing devices which are supplied with energy from the gas storage means and are intended for removing twistlocks from and inserting them into the container.

A lashing platform of this type is for example known from WO 2007/098749 A1 or DE 10 2009 020 999 A1.

A particular advantage of this system is that the slot grippers for inserting twistlocks in and for removing them from the safety fittings of the container can be operated solely by the energy that is being released when a container is set down on the lashing platform.

However it is a disadvantage that the electrical/electronic components such as for example the control system, the sensors and the signalling of the lashing platform have to be fed either by a fixed power supply or by means of rechargeable batteries, a fixed power supply restricting the free positioning of the otherwise advantageous lashing platforms. Despite the fact that the rechargeable batteries can be replaced in a simple manner or can be recharged in a simple manner using the photovoltaic systems installed on the lashing platform, in particular at shady locations or in regions having a long-lasting rainy season it would be desirable to be independent from sunny weather.

SUMMARY OF THE INVENTION

The object of the invention is therefore to provide a lashing platform that is completely independent from external energy sources.

The basic idea of the invention is to use the energy released when setting a container down on the lashing platform for the case that the storage capacity of the gas storage means is exhausted, that is to say the gas reservoir is "full", for supplying energy to the electrical/electronic components, in particular the control system.

BRIEF DESCRIPTION OF THE DRAWINGS

The invention is explained in more detail using an exemplary embodiment of particularly favourable design that is shown in the single FIG. 1.

DETAILED DESCRIPTION OF THE INVENTION

FIG. 1 shows a schematic overview of part of the liquid streams within a lashing platform according to the invention that is of a particularly favourable design. The lashing platform 10 exhibits a mount 20 that can be lowered and on which a container can be set down, it being possible for the mount 22 to be lowered according to the weight of the container and the lift of the pumping cylinders 30 arranged below the mount 20. The pumping cylinders 30 are preferably designed as hydraulic pumping cylinders and the lines of the lashing platform 10 as hydraulic lines that carry hydraulic liquids. For uniformly lowering a container that has been set down on the lashing platform 10, actuators 40 that provide for an equalisation between differently loaded hydraulic cylinders 30 are preferably provided.

The mount 20 or the pumping cylinders 30 are connected to the gas storage means 50 preferably by a plurality of first lines 90 that ultimately open into a single line. The gas storage means 50 preferably consists of a gas reservoir 50*b* and a piston reservoir 50*a* that holds a hydraulic liquid on one side. As is known, the gas storage means 50 is connected to screwing devices 80, that are supplied with energy from the gas storage means 50, for removing twistlocks from and inserting them into the container by means of one or preferably a plurality of second lines 100.

According to the invention, a third line 110 that is preferably designed as a hydraulic line is now provided that is connected to the first line and/or to the gas storage means 50. On its other side, the third line is particularly preferably connected to a tank 60 for receiving a hydraulic liquid, atmospheric pressure prevailing in the tank 60 and the hydraulic liquid collected there serving as a reservoir for the pumping cylinders 30.

This arrangement now results in different possibilities for utilising the energy that is released when setting down containers having different container weights, by conveying a hydraulic liquid through the pumping cylinders in different numbers and composition into the gas reservoir 50 or the tank 60.

In case energy is to be stored and the gas storage means 50 is empty, the hydraulic liquid is fed completely to the gas storage means 50, and the energy that is released when setting down the container on the lashing platform is completely stored in the gas storage means 50. When the container is taken down from the lashing platform 10, the hydraulic cylinders 30 suck in the hydraulic liquid from the tank 60 so that the lashing platform 10 is ready for a further setting-down procedure. The energy stored in the gas storage means 50 can be supplied at a later time by the second line to the screwing means 80, the hydraulic liquid being fed back into the reservoir of the tank 60.

If the gas storage means 50 is filled completely, the volumetric flow guided in the first line can be guided directly to the screwing means 80 via the second line. As an alternative, the volumetric flow carried in the first line can be fed into the third line and fed to the generator 70 or to the hydraulic motor connected to the generator. It is also conceivable that a part stream is guided to the screwing devices 80 and another part stream to the generator if the gas storage means 50 is full.

It is further also conceivable that even if the gas storage means 50 is not filled completely, a part stream not guided to the gas storage means 50 is guided to the screwing devices 80 and/or this or a further part stream is guided to the generator 70. To this end, the second line and the third line are preferably laid out in parallel.

For guiding or regulating the part streams, a control system that exhibits appropriate sensors is to be provided that acts on appropriate actuators, e.g. valves.

The entire volumetric flow can finally also be guided directly to the tank 60 without hydraulic liquid being guided to the gas storage means 50, the screwing devices 80 and the generator 70. This may be requisite for example for maintenance work.

A particularly simple regulation of the volumetric flows that are present in the three lines can be achieved in that a pressure valve, in particular a pressure sequence valve, is provided that activates the third line when a pressure on the gas storage means 15 is exceeded and supplies the excessive energy, not required for operating the screwing devices 80, to the generator 70 for the purpose of obtaining electric energy.

According to a particularly advantageous design example, the energy generated by the generator 70 can be supplied to a rechargeable battery 120 and stored therein. The electric energy is supplied to the electrical/electronic components 130 of the lashing platform 10.

Using the present invention it is possible to provide a lashing platform that operates completely independently in terms of energy.

The invention claimed is:

1. A lashing platform with a mount for mounting a container set down on the lashing platform, wherein the mount is spring-mounted in the vertical direction and is connected via a first line to a gas storage means for storing the energy released when setting the container down on the mount of the lashing platform, and the gas storage means is connected via a second line to screwing devices which are supplied with energy from the gas storage means and are intended for removing twistlocks from and inserting them into the container, characterized by a third line connected to at least one of the first line and the gas storage means, and a generator for producing electrical energy that is driven by the volumetric flow conveyed in the third line.

2. The lashing platform according to claim 1, characterised by an actuator that regulates the volumetric flow that is guided in the third line.

3. The lashing platform according to claim 2, characterised in that the actuator is a pressure valve.

4. The lashing platform according to claim 1, characterised in that the first and the second lines are designed as lines that carry a hydraulic liquid.

5. The lashing platform according to claim 1, characterised in that the gas storage means consists of a hydraulic reservoir and a piston reservoir that holds a hydraulic liquid.

6. The lashing platform according to claim 1, characterised in that the third line is designed as a line that carries a hydraulic liquid and is connected to a tank for receiving the hydraulic liquid.

7. The lashing platform according to claim 1, characterised in that the second and third lines are laid out in parallel.

8. The lashing platform according to claim 1, characterised in that the generator is designed for supplying energy to electrical/electronic components of the lashing platform.

9. The lashing platform according to claim 1, characterised by a rechargeable battery connected to the generator.

10. The lashing platform according to claim 9, characterised in that the rechargeable battery is designed to supply electric energy to the lashing platform.

11. The lashing platform according to claim 1, characterised in that the second and third lines are designed as lines that carry a hydraulic liquid and are connected to a tank for receiving the hydraulic liquid.

12. The lashing platform according to claim 11, characterised in that the second and third lines are laid out in parallel between the first line and the tank.

13. The lashing platform according to claim 11, characterised in that the second and third lines are laid out in parallel between the gas storage means and the tank.

14. The lashing platform according to claim 1, characterised in that the second and third lines are laid out in parallel such that a volumetric flow conveyed in the first line is selectively conveyable to only the screwing devices, only the generator or both the screwing devices and the generator.

15. The lashing platform according to claim 1, characterised in that the second and third lines are laid out in parallel such that a volumetric flow conveyed from the gas storage means is selectively conveyable to only the screwing devices, only the generator or both the screwing devices and the generator.

* * * * *